US008225618B2

(12) United States Patent
Boyd et al.

(10) Patent No.: US 8,225,618 B2
(45) Date of Patent: Jul. 24, 2012

(54) REFRIGERANT RECOVERY METHOD AND APPARATUS

(76) Inventors: David J. Boyd, Farmingville, NY (US); Max E. Massac, Miami, FL (US); Charles R. Shambaugh, Coral Gables, FL (US)

( * ) Notice: Subject to any disclaimer, the term of this patent is extended or adjusted under 35 U.S.C. 154(b) by 1062 days.

(21) Appl. No.: 11/282,952

(22) Filed: Nov. 21, 2005
(Under 37 CFR 1.47)

(65) Prior Publication Data

US 2011/0100037 A1 May 5, 2011

Related U.S. Application Data

(60) Provisional application No. 60/629,314, filed on Nov. 19, 2004.

(51) Int. Cl.
*F25B 45/00* (2006.01)

(52) U.S. Cl. ..... 62/77; 62/292

(58) Field of Classification Search ..... 62/77, 115, 62/149, 292, 498
See application file for complete search history.

(56) References Cited

U.S. PATENT DOCUMENTS

| | | | | |
|---|---|---|---|---|
| 4,467,621 | A * | 8/1984 | O'Brien | 62/324.1 |
| 5,606,862 | A * | 3/1997 | Peckjian et al. | 62/77 |
| 6,247,325 | B1 * | 6/2001 | Muston et al. | 62/292 |
| 6,905,535 | B2 * | 6/2005 | Keefer et al. | 96/125 |
| 7,087,331 | B2 * | 8/2006 | Keefer et al. | 429/411 |

* cited by examiner

*Primary Examiner* — Mohammad Ali
(74) *Attorney, Agent, or Firm* — Baker & Hostetler LLP

(57) ABSTRACT

A method and apparatus for recovering fluids in various states from a system includes a motor that is configured to engage a compressor in a first direction and engage a compressor in a second direction depending on the fluids contained therein.

17 Claims, 7 Drawing Sheets

REFRIGERANT RECOVERY METHOD AND APPARATUS

CROSS-REFERENCE TO RELATED APPLICATIONS

This application claims priority to U.S. Provisional Application entitled, REFRIGERANT RECOVERY METHOD AND APPARATUS, filed Nov. 19, 2004, having a Ser. No. 60/629,314, the disclosure of which is hereby incorporated by reference in its entirety.

FIELD OF THE INVENTION

The present invention relates generally to recovery of fluids in varying states. More particularly, the present invention relates to a single device that is capable of recovering gases such as refrigerant in both a liquid and gas state.

BACKGROUND OF THE INVENTION

Gases such as refrigerants are used in a variety of applications for a variety of uses. Refrigerant gases are used in refrigerators and air conditioning units in order to achieve lower ambient temperatures. For example, refrigerant gas is used in air conditioning systems in order to achieve lower temperatures. Additionally, the refrigerant gases are used in storages device such as refrigerators and freezers. The gases are used to lower the temperature inside these devices in order to protect items stored therein.

These gases are stored in a closed loop system in order to prevent them from leaking. If the gases were to leak, then the systems are limited by their ability to lower the temperature.

The mechanical systems, in which the gases are stored, are subject to failure and breakdown and therefore require maintenance. When repairing these systems due to leaks or other problems, these closed systems must be opened. Unbeknownst to many, the opening of these systems allows the gases to escape and in some instances cause environmental damage.

Various governmental entities have taken action in response to this damage and have enacted laws to ensure that these gases are not allowed to escape into the atmosphere. These laws or regulations require that the refrigerant be removed from the system and stored in another closed system.

An inherent problem with the regulations is that the various portions of refrigerant can be in different states in the system. Therefore, one system is needed to remove liquid refrigerant and another system is needed to remove any gas refrigerant and other impurities. By having two separate systems, the cost is exponential greater to the technician. Additionally, by having two separate systems, the technician would need to bring two fairly heavy systems with him to the location of the closed system. This is particularly difficult for commercially refrigerant systems that are located on rooftops.

Accordingly, it is desirable to provide a method and apparatus that enables a technician to use one device in order to recovery varying states of a gas and impurities from a system. It is further desirable to provide a device that is easily transportable from location to location.

SUMMARY OF THE INVENTION

The foregoing needs are met, to a great extent, by the present invention, wherein in one aspect an apparatus is provided that in some embodiments includes a bidirectional motor to which a compressor is attached to one side of the motor and a vacuum pump is attached to the other side. By combining a motor into the apparatus that simultaneously attaches to a compressor and apparatus, a mechanical system is able to be purged of all gases and fluids with a single tool.

In accordance with one embodiment of the present invention, a recovery apparatus includes a motor, a compressor linked to one side of the motor and a vacuum pump linked to the other side of the motor. The recovery apparatus is configured such that when the motor rotates in one direction it engages the compressor and when it rotates in a second direction, the motor engages the compressor.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
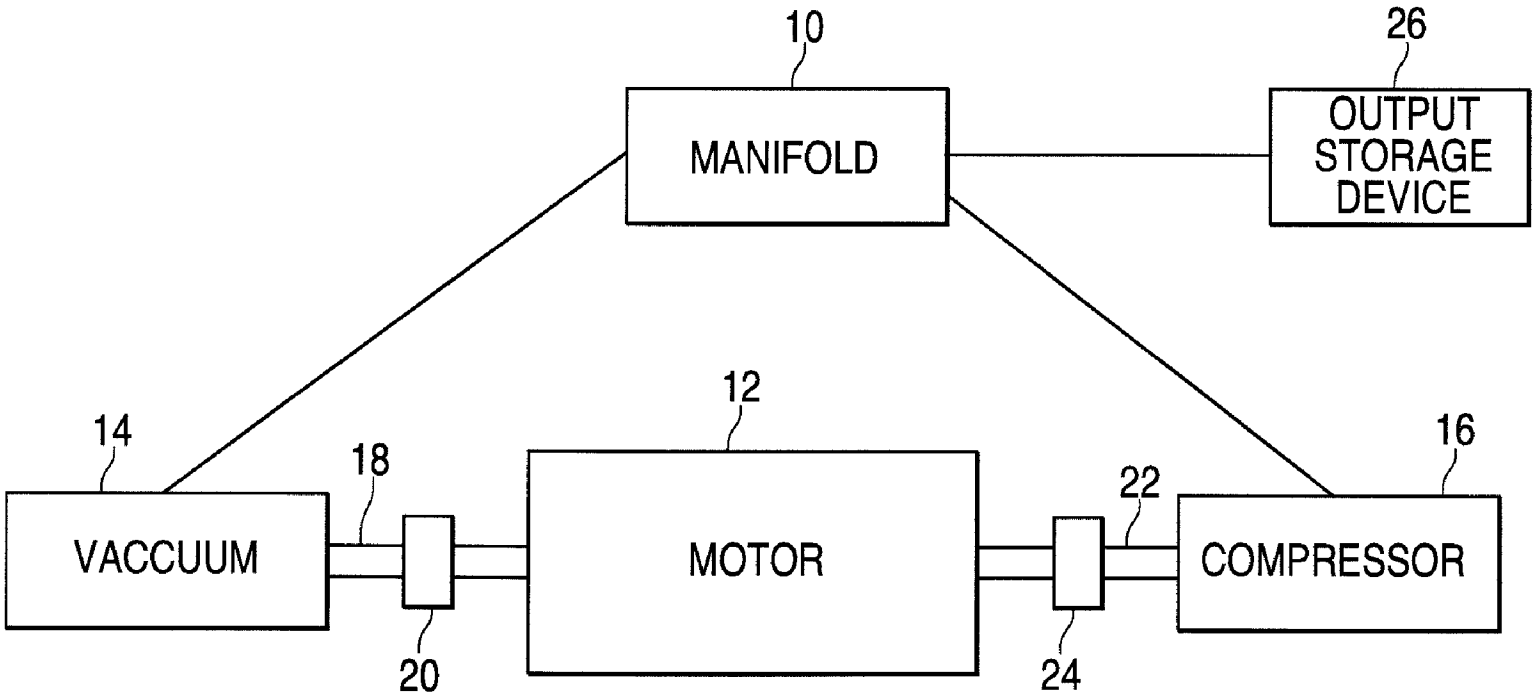
FIG. 1 is a functional block diagram according to a preferred embodiment of the invention.

The invention will now be described with reference to the drawing figures, in which like reference numerals refer to like parts throughout. An embodiment in accordance with the present invention provides a single device that permits both recovery and evacuation of gases from a mechanical system. The embodiment further permits a single motor to be used to run both a vacuum and a compressor in order to achieve the evacuation and recovery of the gases.

An embodiment of the present inventive apparatus and method is illustrated in FIG. 1, which is a functional block diagram. The device 10 includes a motor 12. Attached to the motor 12 are a vacuum 14 and a compressor 16. The motor 12 is connected to the vacuum 14 through a vacuum shaft 18 and a vacuum clutch 20. The motor 12 is also connected to the compressor 16 through a compressor shaft 22 and a compressor clutch 24. As is depicted by FIG. 1, the vacuum 14 and the compressor 16 are located on opposing sides of the motor 12.

The motor 12 is a reversible motor that can rotate in a bidirectional manner. For example, if the motor 12 rotates in one direction, the vacuum shaft 18 is rotated such that it engages the vacuum clutch 20. While the vacuum shaft 18 is rotating in one direction, the compressor shaft 22 is rotating in the same directional as well. However, the compressor clutch 24 is not engaged and therefore the compressor 16 is not activated. The compressor shaft 22 essentially spins freely in this first direction due to the clutch 24.

The motor 12 can rotate in a second direction in which the compressor shaft 22 engages the compressor clutch 24. At the same time, the vacuum shaft 18 rotates in the second direction but does not engage the vacuum 14 because of the vacuum clutch 20. The vacuum shaft 18 essentially spins freely in this second direction due to the clutch 22.

FIG. 1 also depicts an output storage tank 24 that receives and stores the gas from a mechanical system. The device 10 draws the gas from the system and directs it to the output storage tank 24.

The clutches, in the present invention, are known as drawn cup roller clutches. These clutches transmit torques between the shaft and housing in one direction and allow free overrun in the opposite direction. When transmitting torque, either the shaft or the housing can be the input member.

These clutches operate in two modes, the overrun mode and the lock mode. The operation mode is controlled by the direction of the clutch or shaft rotation with respect to the locking ramps located in the clutch. In the overrun mode, the relative rotation between the housed clutch and the shaft causes the rollers to move away from the locking position against the locking ramps in the drawn cup. The housing and the clutch are thus free to overrun in one direction, or the shaft is free to overrun in the other direction.

In the lock mode, the relative rotation between the housed clutch and the shaft is opposite to that in the overrun mode. The rollers, assisted by the leaf type springs, become wedged between the locking ramps and the shaft as well is opposite to that in the overrun mode. The rollers, assisted by the leaf type springs, become wedged between the locking ramps and the shaft to transmit torque between two members. Either the member housing the clutch drives the shaft in one direction, or the shaft can drive the clutch and its housing member in the other direction. The present invention uses a Torrington drawn cup roller clutch, which is manufactured by the The Torrington Company, in Torrington, Conn.

Figure 2:
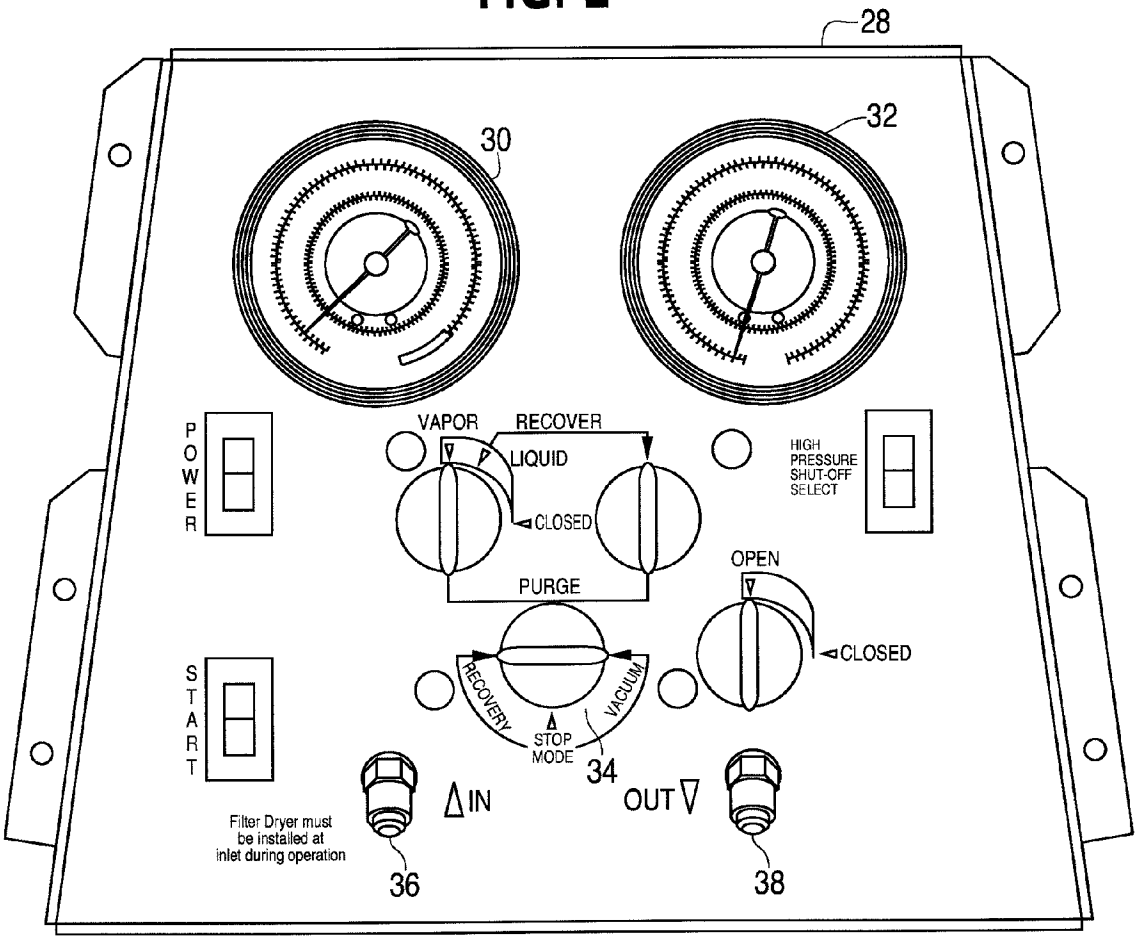
FIG. 2 is a front view of the instrument panel according to the preferred embodiment of the present invention.

FIG. 2 is a front view of the instrument panel 28 according to the preferred embodiment of the present invention. The instrument panel 28 illustrates a first gauge 30 and a second gauge 32 that aids a technician to monitor the recovery and evacuation system. The instrument panel 28 includes an actuator 34 that enables the technician to alternate between recovery and vacuum, which is the evacuate mode. The instrument panel further includes an input port 36 and an output port 38.

Figure 3:
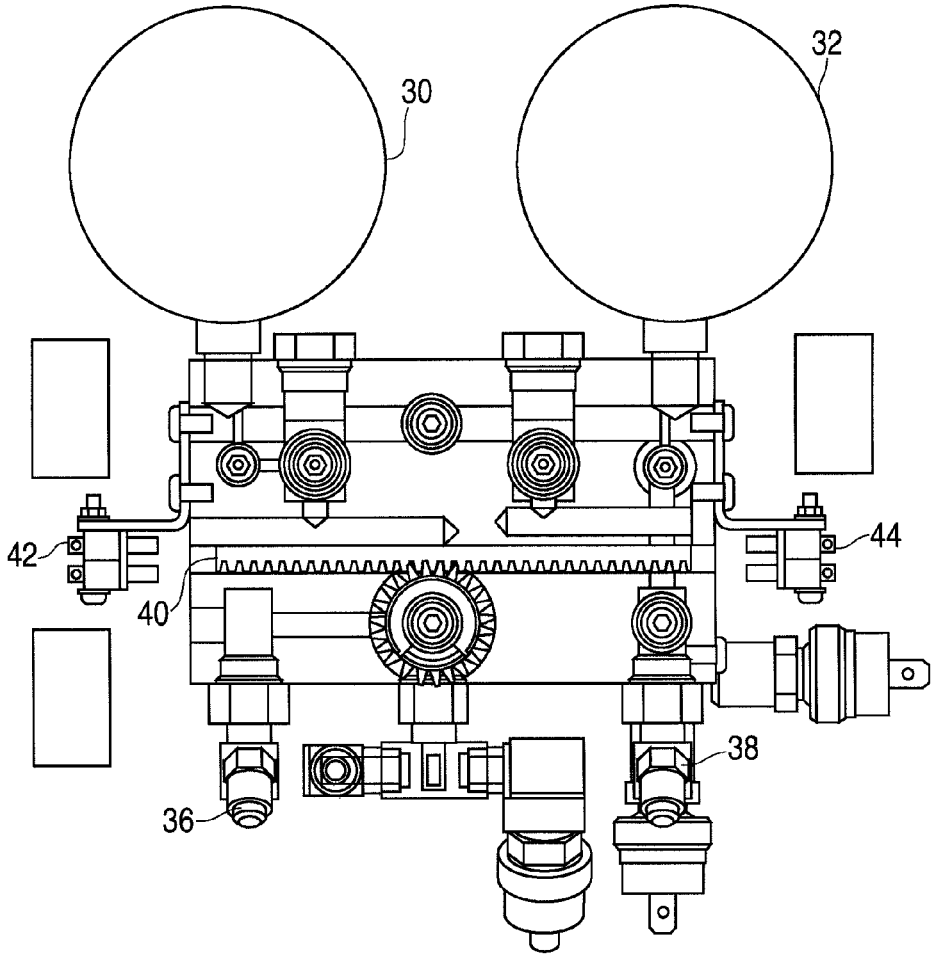
FIG. 3 is a schematic of the manifold according to the preferred embodiment of the present invention.

FIG. 3 is an internal view of the instrument panel 28. The figure details the internal valve structure for the present invention. The actuator 34 alters the flow path of the present invention based upon the mode selected. The actuator 34 accomplishes two goals. The first goal is to alter the flow path based on the mode of the system selected. Therefore, if the recovery mode is selected, then the flow path is in a first direction. If the evacuate mode is selected, then the flow path in changed or altered to a second direction.

The second goal of the actuator 34 is that it moves an electrical contact bar 40 into the appropriate position based upon the mode selected. For example, if the actuator is positioned in the vacuum mode, then the contact bar 40 is positioned in contact with the vacuum electrical connection 42. If the recovery mode is selected, the contact bar 40 is positioned such that it is in contact with the compressor electrical connection 44. In either instance, the contact bar 40 is positioned through the gears of both the actuator 34 and the contact bar 40.

Once the contact bar 40 is contact with one of the electrical connections 42, 44, power is then able to be supplied to the requisite device. For example, if the actuator 34 is in the vacuum mode, then an electrical connection is made with the contact bar 40 such that the power is able to be supplied to the vacuum pump 14. If the actuator 34 is in the compressor mode, then an electrical connection is made with the contact bar 40 such that the power is able to be supplied to the compressor 16.

Figure 4:
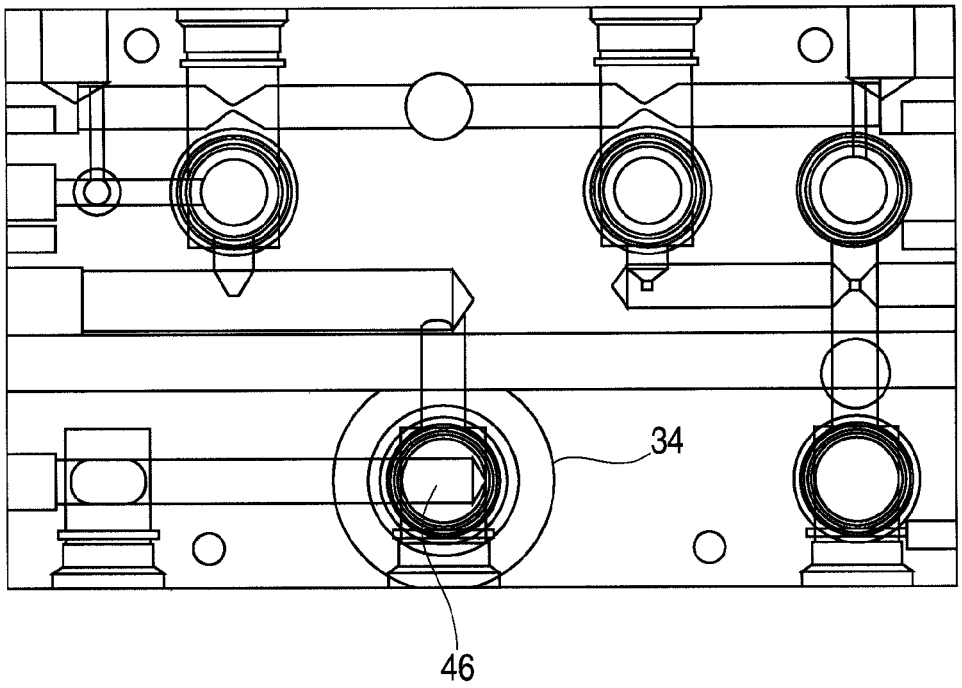
FIG. 4 illustrates the valve layout of the manifold according to the preferred embodiment of the present invention.

FIG. 4 is a front view diagram of the valve portion of the present invention. This figure, illustrates in greater detail, the valve path assembly. Specifically, this figure depicts the internal chamber of the actuator 34 in which a valve 46, such as a ball valve, is moved from a first position to a second position. FIG. 4 illustrates the valve 46 in an open position such that the gases received at the input port are permitted to travel through the flow paths. In this open position, the actuator 34 is in the recovery mode.

Figure 5:
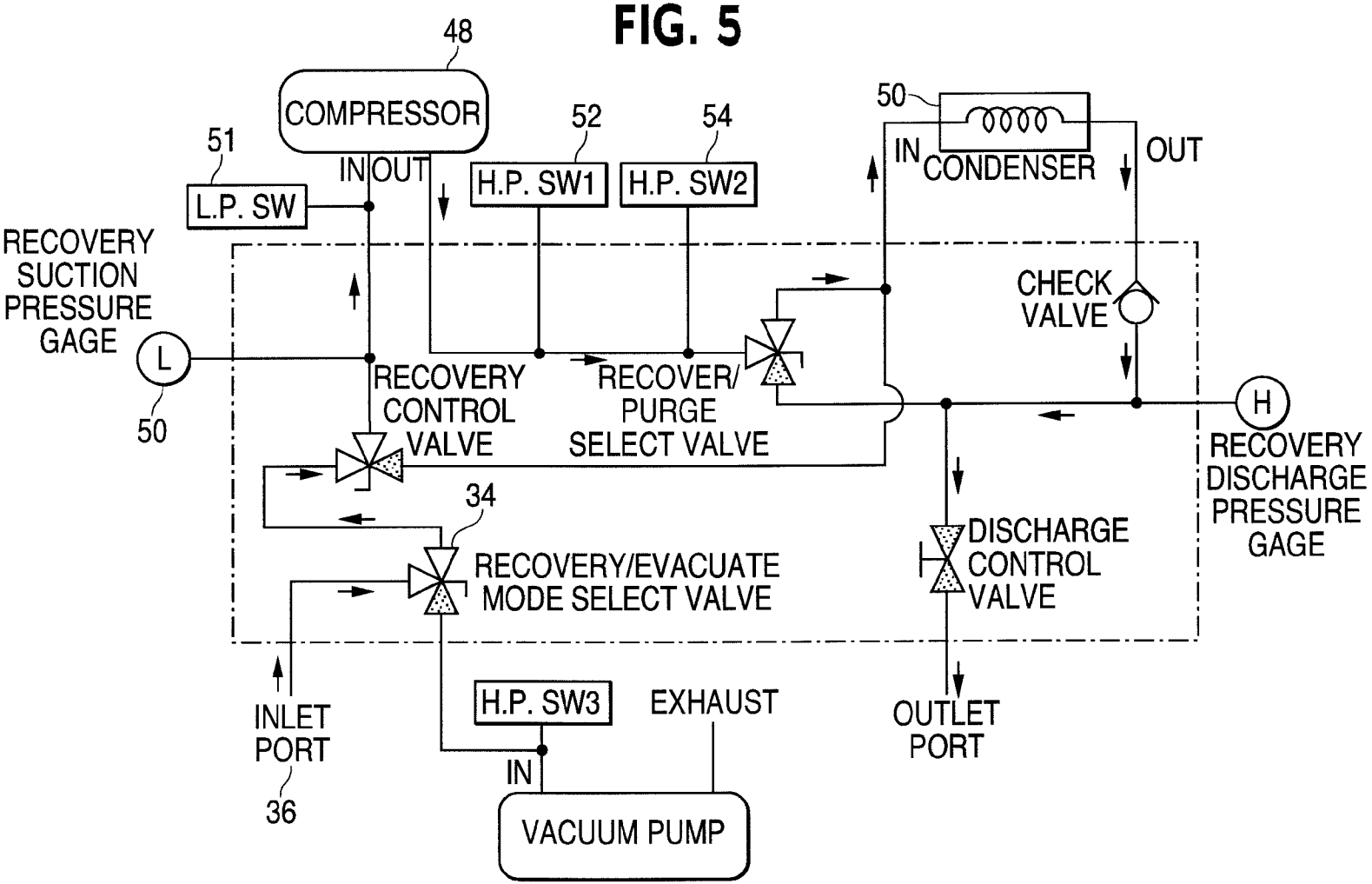
FIG. 5 is a flow diagram of the recovery mode according to the preferred embodiment of the present invention.

FIG. 5 is a flow diagram of the recovery mode according to the preferred embodiment of the present invention. At the inlet port 48, the gas in drawn into the system, pass the actuator 34 and then on to the compressor 48. Positioned between the compressor and the actuator 34 is a pressure gage 50 in order to monitor the recovery suction. Additionally, there is a low pressure switch 51 positioned between the gage 50 and the compressor 48.

The low pressure switch 51, in the preferred embodiment, is included in the present invention because the compressor 48 is an oil-less compressor. The compressor relies on the oil in the refrigerant for lubrication for such things as the piston seals.

When the present invention is in the recovery mode, there needs to be a minimum amount of pressure in the system especially for the oil-less compressor which requires lubrication in order to operate. If there is not a minimum amount of pressure, then low pressure switch 51 is activated and the compressor is disconnected. The low pressure switch 51 prevents the compressor from being operated in an oil-less environment.

The output of the compressor 48 is then passed through a condenser 50 and then delivered to the output port 38. In between the compressor 48 and the condenser 50 are a first high pressure switch 52 and a second high pressure switch 54.

Figure 6:
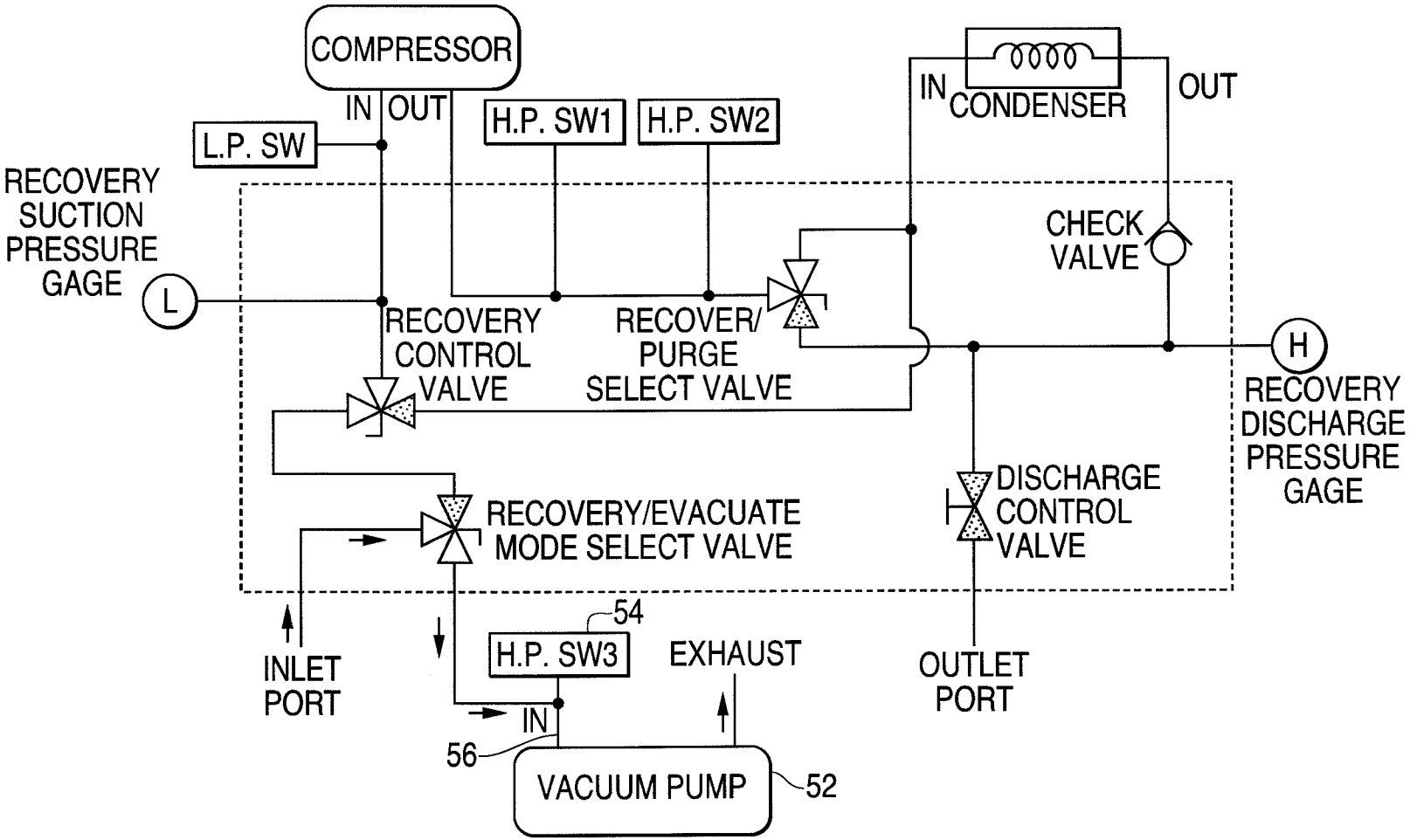
FIG. 6 is a flow diagram of the evacuation mode according to the preferred embodiment of the present invention.

FIG. 6 is a flow diagram of the evacuation mode according to the preferred embodiment of the present invention. In this figure, the actuator 34 is set to vacuum or evacuation mode. The flow path is altered such that the fluid or gas flows through the input port 36 and passed directly to the vacuum pump 52, which then exhausts the fluid to the atmosphere.

The vacuum pump 52 has a high pressure switch 54 that is mounted at the vacuum input port 56. In the preferred embodiment, the high pressure switch 54 is set at five pounds per square inch (PSI). This switch 54 does not allow the motor 12 to engage vacuum pump 52 if there is pressure at the inlet port 56. Pressure can be detected in evacuate mode for such things as incorrect connections. If there is pressure, then the electrical circuit to the motor is opened. The open circuit prevents the vacuum pump 52 from operating. If pressure is allowed to enter to the vacuum pump 52, then the vacuum pump 52 is likely to be damaged.

Figure 7:
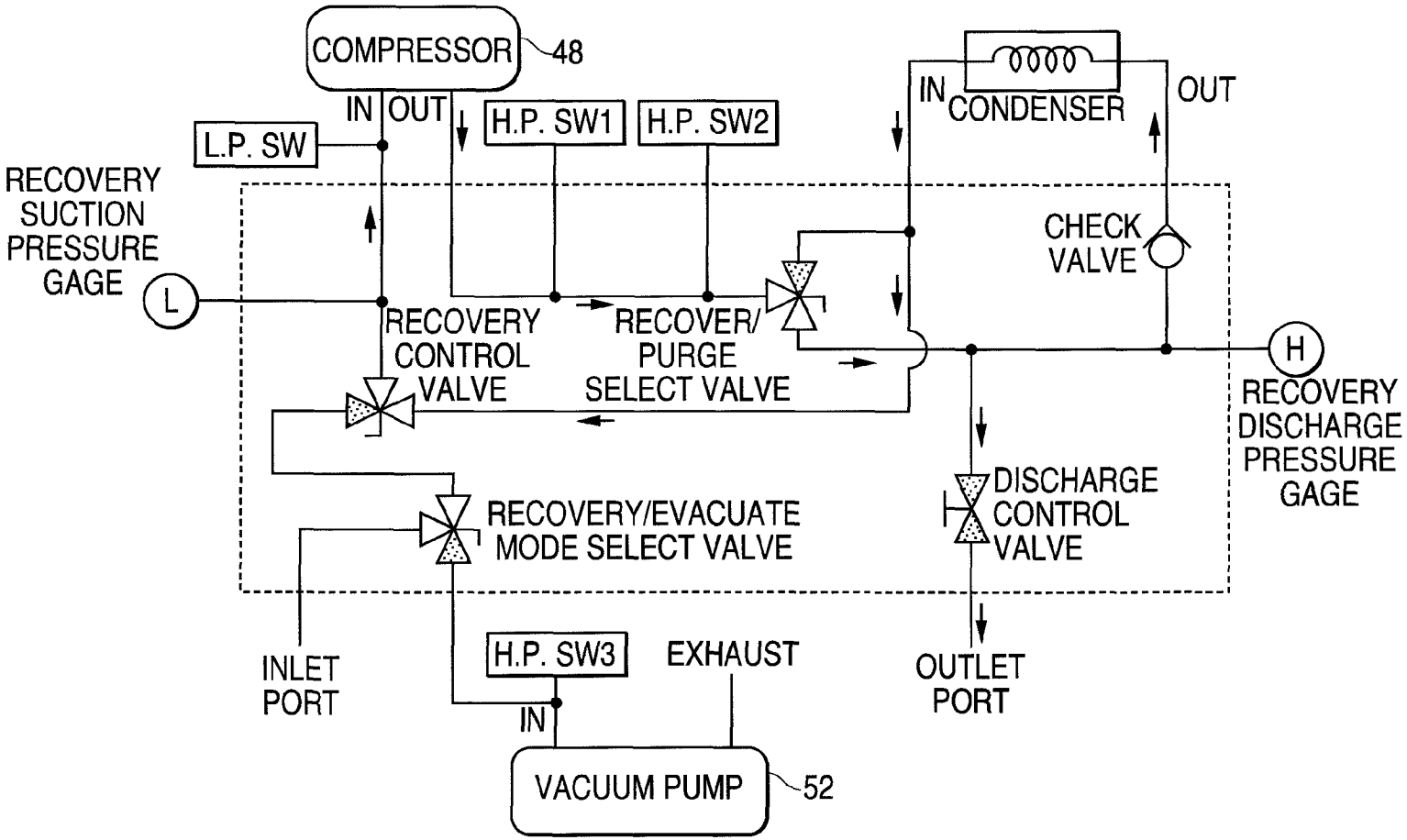
FIG. 7 is a flow diagram of the recovery purge mode according to the preferred embodiment of the present invention.

FIG. 7 is a flow diagram of the recovery purge mode according to the preferred embodiment of the present invention. In this mode, the actuator 34 is closed such that no more gas or fluid is permitted to enter the present invention either to the compressor 48 or the vacuum pump 52. As the directional arrows indicate, the flow path for the recovery mode is completely closed such that any gas or liquid remaining in the system is cleaned out and passed on to the outlet port 38 and on to the storage tank 26.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A recovery apparatus, comprising:

a motor;

a compressor linked to one side of the motor;

a vacuum pump linked to another side of the motor;

a vacuum shaft that connects the motor and the vacuum pump; and an actuator, wherein the vacuum shaft connects to the motor and the vacuum pump through a clutch;

wherein the clutch engages the vacuum shaft in a first direction and does not engage the vacuum shaft in second direction;

wherein the actuator is configured to be movable between a recovery mode and an evacuate mode; and wherein the actuator is configured to displace an electrical contact bar in response to a mode selected.

2. The recovery apparatus as in claim 1, further comprising a compressor shaft that connects the motor and the compressor.

3. The recovery apparatus as in claim 2, wherein the compressor shaft connects to the motor and the compressor through a clutch.

4. The apparatus as in claim 1, further comprising a lower pressure switch.

5. The apparatus as in claim 4, wherein the lower pressure switch is used in conjunction with an oil-less compressor.

6. The apparatus as in claim 5, further comprising a higher pressure switch.

7. The apparatus as in claim 6, wherein the higher pressure switch is positioned at an input port of the vacuum pump.

8. The apparatus as in claim 7, wherein the higher pressure switch prevents the motor from engaging the vacuum pump if there is pressure at the input port.

9. A method for recovering refrigerant within an apparatus comprising:

operating a motor in a first direction and a second direction;

operating a vacuum pump by rotating a shaft of the motor in the first direction;

operating a compressor by rotating the shaft of the motor in the second direction; and operating an actuator, wherein the shaft connects to the motor and the vacuum pump through a clutch;

wherein the clutch engages the shaft in a first direction and does not engage the vacuum pump in second direction;

wherein the actuator is configured to be movable between a recovery mode and an evacuate mode; and wherein the actuator is configured to displace an electrical contact bar in response to a mode selected.

10. The method as in claim 9, wherein the shaft of the motor does not engage the compressor by rotating in the first direction.

11. The method as in claim 9, wherein the shaft of the motor does not engage vacuum by rotating in the second direction.

12. The method as in claim 9, wherein the shaft of the motor is linked to the compressor with a first drawn cup roller clutch.

13. The method as in claim 10, wherein the shaft of the motor is linked to the vacuum pump with a second drawn cup roller clutch.

14. A system for recovering refrigerant within an apparatus comprising:

means for rotating a motor shaft in a first direction and a second direction;

means for engaging a vacuum pump with the shaft when the means for rotating rotates in the first direction;

means for engaging a compressor with the shaft when the means for rotating rotates in the second direction; and means for actuating;

wherein the vacuum pump connects to the means for rotating through a clutch;

wherein the clutch engages the vacuum pump in a first direction and does not engage the vacuum pump in second direction;

wherein the means for actuating is configured to be movable between a recovery mode and an evacuate mode; and wherein the means for actuating is configured to displace an electrical contact bar in response to a mode selected.

15. The system as in claim 14, wherein the shaft of the motor does not engage the compressor by rotating in the first direction.

16. The system as in claim 14, where the means for engaging the vacuum is a drawn cup roller clutch.

17. The system as in claim 14, where the means for engaging the compressor is a drawn cup roller clutch.

* * * * *